US008844642B2

(12) United States Patent
Combs

(10) Patent No.: US 8,844,642 B2
(45) Date of Patent: Sep. 30, 2014

(54) AUTOMATIC FLOW RESTRICTOR FOR FIREFIGHTING APPARATUS

(75) Inventor: Eric N. Combs, Goshen, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 631 days.

(21) Appl. No.: 12/554,430

(22) Filed: Sep. 4, 2009

(65) Prior Publication Data

US 2010/0059234 A1 Mar. 11, 2010

Related U.S. Application Data

(60) Provisional application No. 61/094,659, filed on Sep. 5, 2008.

(51) Int. Cl.
*A62C 25/00* (2006.01)

(52) U.S. Cl.
USPC ..... 169/51; 239/452; 239/539; 239/587.1; 239/458; 169/52; 169/20

(58) Field of Classification Search
USPC ..... 169/19, 20, 24, 51, 52, 54, 67; 239/587.1, 587.2, 587.6, 166, 539, 239/452, 458, 457
See application file for complete search history.

(56) References Cited

U.S. PATENT DOCUMENTS

| | | | |
|---|---|---|---|
| 1,469,790 | A | 10/1923 | Hysko |
| 2,388,481 | A | 11/1945 | Green |
| 2,566,856 | A | 9/1951 | Rose |
| 2,646,312 | A | 7/1953 | Ware et al. |
| 2,649,927 | A | 8/1953 | Ortega |
| 3,045,412 | A | 7/1962 | Bowman |
| 3,220,638 | A | 11/1965 | Petersen |
| 3,290,865 | A | 12/1966 | Serou et al. |
| 3,296,777 | A | 1/1967 | Jackson et al. |
| 3,909,219 | A | 9/1975 | Fromknecht |
| 4,057,364 | A | 11/1977 | Bratschitsch |
| 4,185,974 | A | 1/1980 | Hiester |

(Continued)

FOREIGN PATENT DOCUMENTS

| | | |
|---|---|---|
| CA | 665265 | 6/1963 |
| FR | 2641193 | 12/1988 |
| JP | 2003-079757 | 3/2003 |
| WO | 2008/033916 A2 | 3/2008 |

OTHER PUBLICATIONS

International Search Report and Written Opinion from corresponding Patent Cooperation Treaty Application No. PCT/US2009/056047, dated Apr. 19, 2010, which corresponds to U.S. Appl. No. 12/554,430.

(Continued)

*Primary Examiner* — Len Tran
*Assistant Examiner* — Trevor E McGraw
(74) *Attorney, Agent, or Firm* — Faegre Baker Daniels LLP

(57) ABSTRACT

An automatic flow restrictor includes a movement sensor that detects undesired movement of a firefighting apparatus relative to a support surface and automatically reduces the flow of fluid through the apparatus to thereby reduce reaction forces acting upon the apparatus. The sensor may be a slidable member or an actuatable lever, for example, that detects movement of the apparatus along or away from a support surface, and actuates an adjuster to restrict the flow of fluid until the forces are balanced and the apparatus stops moving relative to the support surface.

23 Claims, 4 Drawing Sheets

(56) References Cited

U.S. PATENT DOCUMENTS

| | | | | |
|---|---|---|---|---|
| 4,201,536 | A | 5/1980 | Suzuki | |
| 4,508,550 | A | 4/1985 | Berfield et al. | |
| 4,623,366 | A | 11/1986 | Berfield et al. | |
| 4,674,686 | A * | 6/1987 | Trapp | 239/279 |
| 4,797,072 | A | 1/1989 | Berfield et al. | |
| 4,880,364 | A | 11/1989 | Berfield et al. | |
| 4,903,893 | A | 2/1990 | Kim | |
| 5,080,578 | A | 1/1992 | Josephs et al. | |
| 5,425,505 | A * | 6/1995 | Jones | 239/276 |
| 5,593,092 | A * | 1/1997 | McMillan et al. | 239/285 |
| 6,305,621 | B1 * | 10/2001 | Kolacz et al. | 239/587.2 |
| 6,354,320 | B1 | 3/2002 | Kolacz et al. | |
| 6,745,957 | B2 * | 6/2004 | Parey | 239/569 |
| 7,097,120 | B2 * | 8/2006 | Marino | 239/539 |
| 7,644,777 | B2 | 1/2010 | Combs et al. | |
| 8,002,201 | B2 * | 8/2011 | Marino | 239/11 |
| 8,006,923 | B2 | 8/2011 | Stoops | |
| 2004/0187922 | A1 | 9/2004 | Fleury, Jr. et al. | |
| 2005/0077381 | A1 | 4/2005 | Combs | |
| 2008/0060706 | A1 | 3/2008 | Combs | |
| 2010/0052310 | A1 | 3/2010 | Stoops | |

OTHER PUBLICATIONS

Nozzle Jet Reaction Forces, Stang Manufacturing, Inc. Publications, Apr. 1, 1989.
Bronco Ground Rover, Akron Brass, Catalog 102, Apr. 1978.
"Firefly" Trailer, Angus Publication, Jun. 1985.
Foam Liquids and Equipment, etc., Aer-o-foam V3 Trailer, CNF Publication, (pp. 21, 22), Rev. Mar. 1986.
Terminator T-2000, CNF Publication, Mar. 1989.
Elkhart Fire Fighting Equipment, Mobile Demonstration Unit (p. 46), 8393 FW Four Wheeled (p. 47), 8393-TW Truck Mounted (p. 47), Elkhart Catalog A, Apr. 1993.
Elkhart Fire Fighting Equipment, 299-11FW Four Wheeled 299-11TW Two Wheeled, 299-11TM Truck Mounted (pp. 30, 31), Elkhart, Catalog T, Mar. 1982.
"Fire Pro Charger", Fire Products Mfg, Aug. 1, 1986.
Diamondback, 4 Wheeled Monitor Cart, Foam Monitor Trailer, Foam Trailer and Skids, "High Volume Foam or . . . " Firecat Foam Monitor Cart, Magnum, undated.
Gun Monitors Cannon Monitors, Sabo Publication (pp. 2, 3), Aug. 1, 1986.
The new Skum "Challenger", Skum Publication, Apr. 1, 1989.
"Wellspring's Portable Monitor Brake", published before Mar. 31, 1994.
"Kero-Sun Portable Kerosene Heater Operation and Maintenance Instructions", published before Mar. 31 1994.
"Heatech Operating Manual and Warranty Registration", Copyright 1988.
Brochure—Blitzfire Oscillating Monitor, Task Force Tips 2001.
Brochure—Blitzfire, Task Force Tips LIX-610 Aug. 19, 2003 Rev 3.
Brochure—Blitzfire Portable Monitor and Max Force Dual Pressure Nozzle, Task Force Tips, LIX-615 Apr. 12, 2011 Rev00.
Manual: Blitzfire Monitor Series, Task Force Tips, LIX-630 Oct. 31, 2008 Rev09.

* cited by examiner

AUTOMATIC FLOW RESTRICTOR FOR FIREFIGHTING APPARATUS

CROSS REFERENCE TO RELATED APPLICATION

The present invention claims the benefit of U.S. provisional application Ser. No. 61/094,659, filed Sep. 5, 2008, which is hereby incorporated herein by reference in its entirety.

FIELD OF THE INVENTION

The present invention relates in general to the field of firefighting equipment and, more specifically, to fluid handling equipment including hoses, monitors, and the like.

BACKGROUND OF THE INVENTION

Firefighting monitors are used to direct the flow of water or other firefighting fluid and include an inlet, which is connected to a hose or pipe, and a discharge outlet to which a nozzle or stream-shaper is mounted. Monitors are often supported on the ground or other generally horizontal support surface and deliver a large quantity of fluid (typically water or foam) either directly to a fire, or to a fire via a hose or other conduit. Ground-supported monitors are typically supplied with fluid by a hose, pipe, or other conduit that at least partially lies along the ground or support surface on which the monitor is resting. Because of the high volume and flow rate of fluid through a typical monitor, large reaction forces may be generated at the monitor in a direction opposite to the direction of fluid discharge. Typical monitors include two or more support legs with ground-engaging feet that resist sliding along the ground due to reaction forces at the monitor. These forces may still cause a monitor to slide along the ground or support surface, or may cause a monitor to "hop", "jump", or rise up off the ground such that control is lost over the monitor and the fluid discharged therefrom.

SUMMARY OF THE INVENTION

Accordingly, the present invention provides an automatic flow restrictor that senses when an associated firefighting apparatus has moved relative to the ground or other support surface, and which reduces the reaction forces acting upon the firefighting apparatus by automatically reducing the flow rate of fluid through the apparatus. The flow restrictor senses translation or sliding movement of the firefighting apparatus along the support surface or, alternatively, senses the apparatus moving away from the support surface, and reduces the flow of fluid through the apparatus to limit or prevent further movement of the firefighting apparatus, The automatic flow restrictor includes a flow adjuster that is controlled by an external slidable member and/or a lever, where the slidable member and lever sense translational and raising movements of the firefighting apparatus, respectively. The movement of the slidable member or lever moves the flow adjuster, which in turn reduces the flow of fluid through the firefighting apparatus to reduce the forces acting upon the apparatus which limits or prevents further undesired movement.

According to one form of the present invention, an automatic flow restrictor for a firefighting monitor or the like includes a tubular body defining a passageway, a compressible member in the passageway, and an adjuster for selectively compressing the compressible member. The tubular body has a longitudinal central axis and includes an inlet and an outlet to the passageway. The compressible member defines a portion of the passageway and has an adjustable inner dimension that is transverse to the longitudinal axis. The adjuster is mounted about the compressible member and is actuatable to selectively compress the compressible member to thereby restrict the flow of fluid through the tubular body. The compressible member is adjustable between an open position and a flow-restricting position in response to the adjuster, in order to limit the reaction forces acting upon the flow restrictor due to fluid flow. The adjuster is actuatable in response to movement of the tubular body with respect to a support surface on which the automatic flow restrictor is supported.

In one aspect, the adjuster is actuated by a slidable member, such as an actuation collar that surrounds at least a portion of the tubular body. The slidable member moves axially along the tubular body in response to sliding movement of the tubular body along the support surface in order to actuate the adjuster and restrict fluid flow through the flow restrictor. Optionally, the slidable member is made of a high-friction material for gripping the support surface.

In another aspect, the compressible member comprises a plurality of compressible members, such as radially-spaced cantilever beams or the like.

In yet another aspect, the adjuster extends around the compressible member and is movable along the longitudinal central axis. The slidable member or other sensor applies pressure on the adjuster, which applies compressive pressure on the compressible member to reduce the fluid flow.

In still another aspect, the compressible member and the adjuster include corresponding ramped portions so that linear travel of the adjuster along the longitudinal central axis applies a compressive force on the compressible member, and whereby fluid pressure can cause the compressible member to expand and move the adjuster when little or no external force is applied to the slidable member or other sensor.

In a further aspect, the automatic flow restrictor includes a movable actuator (such as a pivotally-mounted lever) coupled to the tubular body, a sleeve surrounding at least a portion of the compressible member, a chamber defined between the sleeve, the adjuster, and the tubular body, and a pin coupled to the movable actuator and extending transversely through an aperture in the tubular body. The sleeve defines an aperture for selective fluid communication through a wall of the sleeve. The pin is movable to selectively block the aperture of the sleeve in response to inward movement of the movable actuator toward the tubular body, and the pin is movable in an opposite direction to selectively unblock the aperture in response to outward movement of the movable actuator away from the tubular body. The chamber is in selective fluid communication with the passageway via the aperture in the sleeve when the pin is removed from the aperture of the sleeve by movement of the movable actuator away from the tubular body, in response to the tubular body moving away from the support surface. When the pin is removed from the aperture in the sleeve, pressurized fluid is permitted to enter the chamber from the passageway and urge the adjuster along the compressible member. The adjuster applies compressive pressure on the compressible member in response to the fluid pressure and restricts the flow of the fluid through the passageway.

Optionally, the adjuster is an annular piston that extends around the compressible member and is movable along the longitudinal central axis in response to fluid pressure in the chamber applying pressure on the piston. The movement of the piston applies compressive pressure on the compressible member via corresponding surfaces on the piston and compressible member.

In another aspect, the compressible member includes a ramped portion so that linear travel of the piston along the longitudinal central axis applies a compressive force on the compressible member and, when the aperture in the sleeve is blocked by the pin, allows the compressible member to expand under the force of the fluid pressure flowing through the passageway.

Thus, the automatic flow restrictor prevents undesired movement of an associated firefighting apparatus such as a firefighting monitor, by reducing the flow of fluid through the apparatus in response to an initial movement of the apparatus along or away from a support surface. The flow restrictor generally reduces flow through the apparatus by an amount necessary to balance the forces of the apparatus and permit a maximum flow rate at the apparatus without losing control of the apparatus.

These and objects, advantages, purposes, and features of the present invention will become apparent upon review of the following specification in conjunction with the drawings.

DESCRIPTION OF THE PREFERRED EMBODIMENTS

The present invention is directed to an automatic flow restrictor for reducing the reaction forces on a firefighting apparatus, such as a monitor, by automatically reducing the flow of fluid through the apparatus in response to undesired movement thereof. While the present invention is described with reference to a firefighting apparatus in the form of a monitor, it should be understood that the same or similar principles may be used for other apparatuses that are subject to reaction forces in response to fluids flowing therethrough, such as hoses, pipes, nozzles, and the like. As will be more fully described below, the automatic flow restrictor includes a sensing device, such as a slidable member or an actuatable lever, that detects movement of the apparatus along or away from a support surface, and restricts the flow of fluid through the apparatus in response to that movement. Thus, when the firefighting apparatus begins to move along or away from a support surface in response to reaction forces caused by firefighting fluids flowing through the apparatus, the automatic flow restrictor reduces the flow through the apparatus until the forces are balanced and the apparatus stops moving relative to the support surface and remains substantially in place.

Figure 1:
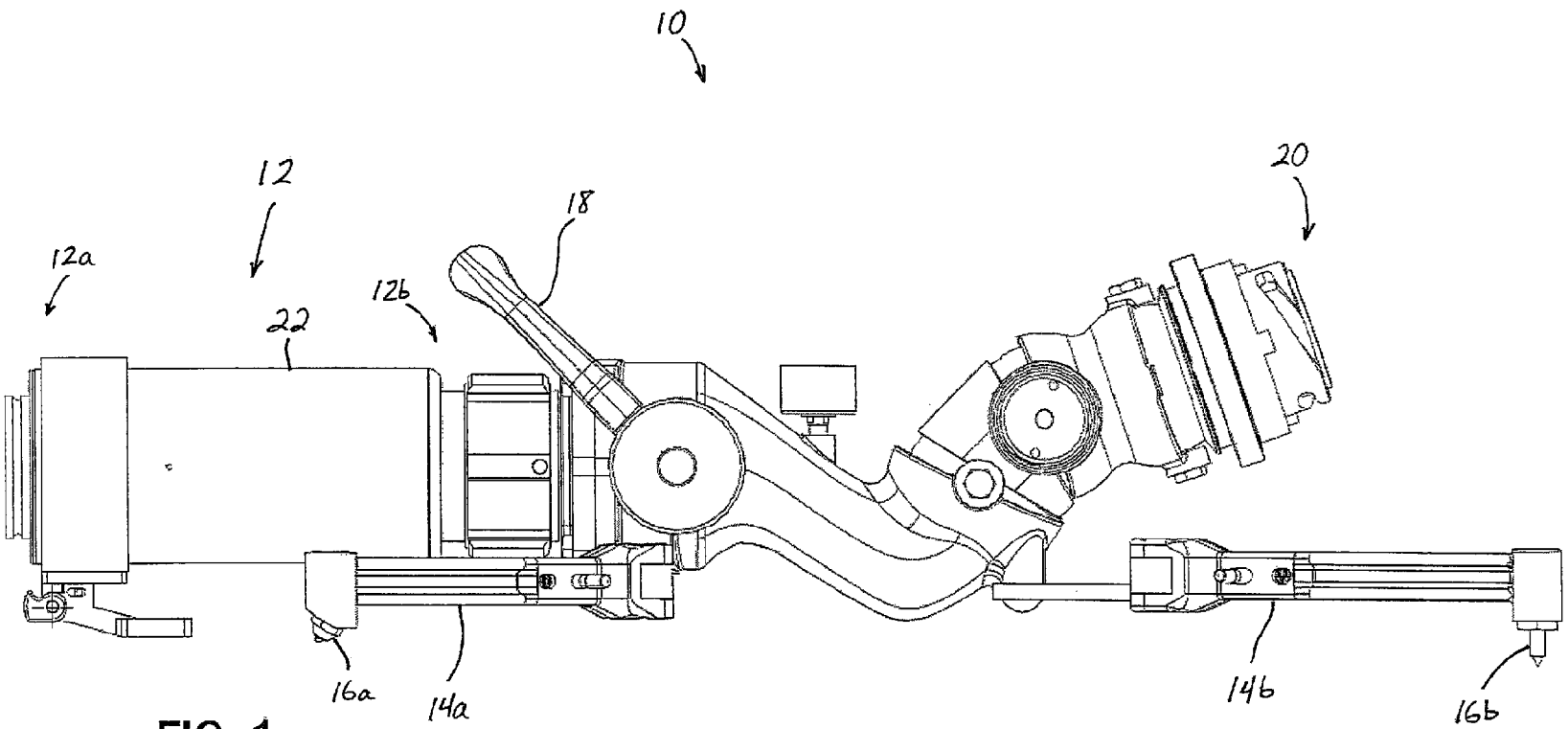
FIG. 1 is a side elevation of a monitor assembly with an automatic flow restricting device of the present invention.
Figure 2:
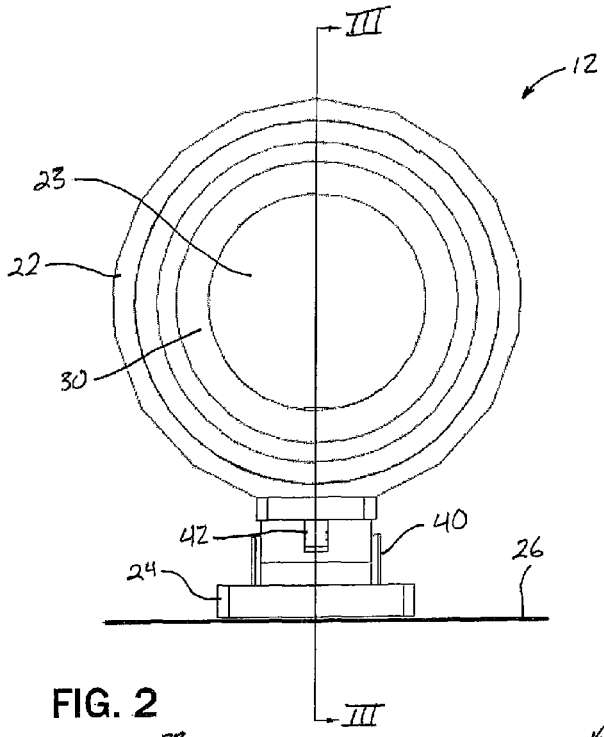
FIG. 2 is a front end elevation of the flow restricting device of FIG. 1 with the device in a fully open position.

Referring now to FIG. 1, the numeral 10 generally designates a firefighting monitor assembly including an automatic flow restrictor 12 for limiting or substantially preventing monitor assembly 10 from rising up off of the ground or a support surface. Monitor assembly 10 includes at least two movable support legs 14*a*, 14*b* with respective feet 16*a*, 16*b* that engage the ground or support surface to resist sliding by the monitor assembly along the ground or support surface. A valve control handle 18 controls the flow of firefighting fluid through the monitor assembly 10 and out through a discharge end 20, which may normally be fitted with a nozzle, a stream-shaper, a conduit, or the like. For additional detail on suitable monitors that may be used in conjunction with automatic flow restrictors of the present invention, reference is made to commonly assigned U.S. Pat. No. 4,674,686 and copending U.S. application Ser. No. 10/962,271 (U.S. Publ. No. 2005/0077381) filed Oct. 8, 2004 and entitled FIRE-FIGHTING MONITOR, which are hereby incorporated herein by reference in their entireties.

Automatic flow restrictor 12 includes an inlet end 12*a* and an outlet end 12*b*. Flow restrictor 12 is coupled to a supply hose, a pipe, or other fluid source at inlet end 12*a*, and is coupled to monitor assembly 10 at outlet end 12*b*. Automatic flow restrictor 12 includes a tubular body 22 defining a passageway 23 (FIGS. 2-5) for conducting firefighting fluids along a longitudinal central axis thereof. A ground-contacting actuator 24 is mounted to tubular body 22. Actuator 24 may be a lever that at least partially supports flow restrictor 12 at a support surface 26, such as the ground or other surface. A compressible member 28, a sleeve 30, and an actuator or adjuster 32, are positioned inside of passageway 23 of tubular body for selectively restricting the flow of fluid through the passageway.

Figure 4:
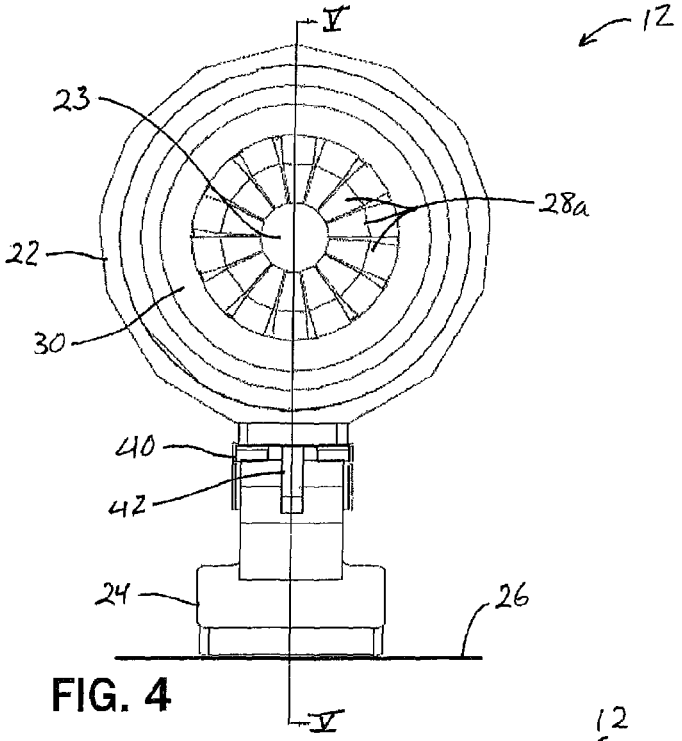
FIG. 4 is an end elevation of the flow restriction device of FIG. 1 in a fully restricted configuration.
Figure 5:
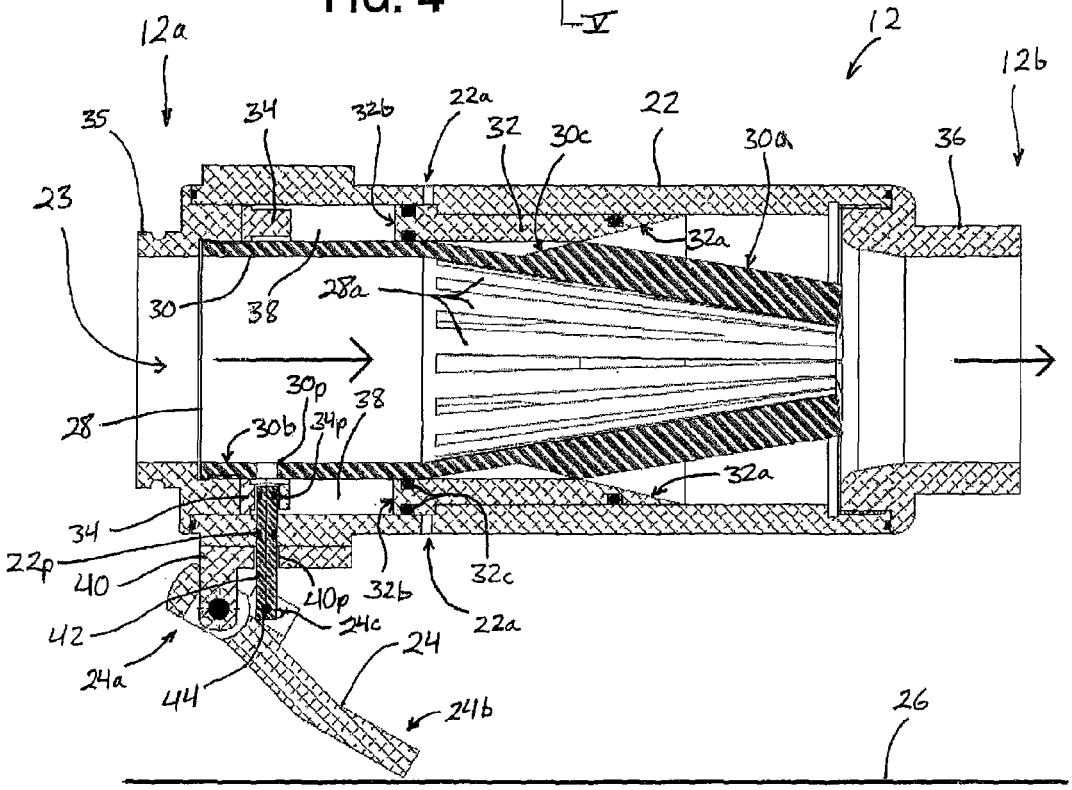
FIG. 5 is a side sectional view of the flow restricting device taken along Section V-V of FIG. 4.

Compressible member 28 is a hollow cylindrical member with a plurality of radially-spaced cantilever beams or compressible members 28*a* that are flexible so as to permit radial deflection of the beams. When beams 28*a* are deflected or compressed inwardly toward the longitudinal axis, firefighting fluid is forced to pass through a reduced area including a generally circular reduced-diameter area surrounded by beams 28*a* and, optionally, including the areas defined between the individual beams (FIGS. 4 and 5). Thus, a portion of compressible member 28 may be deflected to reduce the flow area, and consequently the flow rate, of fluid passing through automatic flow restrictor 12. Compressible member 28 may be made from any sufficiently strong, resilient, and corrosion-resistant material, such as certain metals, for example stainless steel.

Sleeve 30 surrounds at least beams 28*a* of compressible member 28, and is configured to selectively compress or constrict beams 28*a* to reduce the flow of fluid therethrough. In the illustrated embodiment, sleeve 30 includes a relatively thick downstream end portion 30*a*, a relatively thin upstream end portion 30*b*, and a ramped transition region with a ramped surface 30*c* between thick end portion 30*a* and end portion 30*b*. Sleeve 30 may be made from any sufficiently tough, compliant material that is soft and flexible enough to be radially compressed via outside mechanical pressure and expanded by internal fluid pressure over many cycles, such as rubber, synthetic rubber, or certain resinous materials. Optionally, the sleeve and compressible member are combined such that the combined unit includes a plurality of cantilevered beams with ramped outer surfaces, as in compressible member 128, which is described below with respect to FIG. 6.

Figure 3:
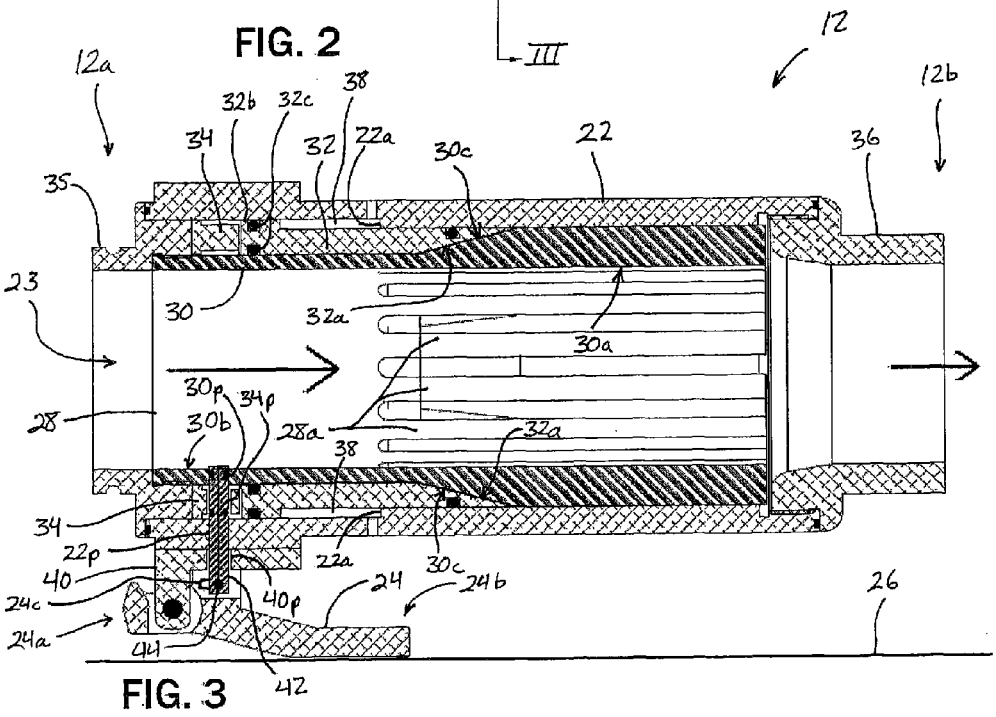
FIG. 3 is a side sectional view of the flow restricting device taken along Section III-III of FIG. 2.

Adjuster 32 is an annular piston that is sealed between tubular body 22 and sleeve 30, and includes a wedge-shaped or ramped downstream end portion 32*a* that rests against ramped surface 30*c* of sleeve 30 when flow restrictor 12 is in its full open position (FIG. 3). Adjuster 32 includes a sealed piston head 32*b* with seals 32*c* forming a fluid-tight sliding interface between piston head 32*b*, tubular body 22, and sleeve 30. As adjuster 32 moves axially along the flow restrictor 12, the ramped surfaces 30*c*, 32*a* slide along one another so that sleeve 30 is compressed radially inwardly on and around compressible member 28, as will be more fully described below. Adjuster 32 is limited in the extent of its axial travel by an annular seal 34 at the upstream end of travel, and by an annular lip 22*a* (FIG. 3) of tubular body 22 at the downstream end of travel.

An inlet member 35 is coupled to inlet end 12*a* of flow restrictor 12 to facilitate coupling the flow restrictor to a hose, a pipe, a conduit, or the like, and also to retain sleeve 30 and compressible member 28 in tubular body 22. An outlet member 36 directs the flow of firefighting fluid (indicated by arrows in FIGS. 3 and 5) out of flow restrictor 12 and into monitor assembly 10, which is coupled to outlet member 36. An annular seal 34 is positioned between adjuster 32 and inlet member 35, and between sleeve 30 and tubular body 22.

An annular chamber 38 (FIG. 5) is selectively formed between adjuster 32 and annular seal 34, and between sleeve 30 and tubular body 22. Adjuster 32 travels longitudinally inside chamber 38 along the longitudinal axis of automatic flow restrictor 12. Vent holes 22*a* in tubular body 22 facilitate movement of adjuster 32 along tubular body 22 by permitting the release of fluid (such as air) from a portion of annular chamber 38 that is located downstream of piston head 32*b* (FIG. 3), and that is defined between tubular body 22 and adjuster 32 when adjuster 32 is in its retracted position (FIG. 3). Optionally, a spring or other resilient member may be positioned in chamber 38 to urge adjuster 32 upstream (toward the non-restricting position) when fluid pressure is not being applied to the upstream side of piston head 32*b*.

Lever 24 is pivotally coupled to tubular body 22 via an L-bracket 40, and is further pivotally coupled to a pin 42 that is selectively driven radially inward and outward relative to tubular body 22. L-bracket 40 pivotally supports lever 24 at a proximal end portion 24*a* of the lever, which includes a distal end portion 24*b* for contacting support surface 26, as in FIGS. 2 and 3. Pin 42 is pivotally coupled to lever 24 in a slot 24*c* located between proximal end portion 24*a* and distal end portion 24*b*. A slot 24*c* in lever 24 receives a cross pin 44 in pin 42 and permits pin 42 to translate (in the pin's axial direction) into and out of passageway 30*p* in response to pivotal movement of lever 24, as in FIGS. 3 and 5.

Lever 24 supports at least a portion of the weight of automatic flow restrictor 12 and/or monitor assembly 10 on support surface 26. Pin 42 is extended when lever 24 is depressed toward tubular body 22 (FIGS. 2 and 3), and pin 42 is retracted when lever 24 is extended outwardly away from tubular body 22 (FIGS. 4 and 5). Optionally, a spring may be provided to bias lever 24 outwardly away from tubular body 22 when a counteracting force (such as gravitational force applied to automatic flow restrictor 12 against support surface 26) is limited or non-existent, as when flow restrictor 12 is lifted partially or fully off of support surface 26.

L-bracket 40 includes a passageway 40*p* aligned with a corresponding passageway 22*p* in tubular body 22, which is aligned with a corresponding passageway 34*p* in annular seal 34, which is aligned with a corresponding passageway 30*p* in sleeve 30. Pin 42 extends through and seals against passageways 40*p*, 22*p*, 34*p*, and is operative (i.e. extendable and retractable via lever 24) to selectively block and unblock passageway 30*p* in sleeve 30, as will be described below. Optionally, one or more vent holes may be provided in tubular body 22 near annular seal 34 to facilitate venting fluid from chamber 38 upstream of piston head 32*b* when pin 42 blocks passageway 30*p* after adjuster 32 has been at least partially moved downstream to compress the compressible member 28, permitting adjuster 32 to move upstream to the non-restricting position due to fluid pressure in passageway 23 acting upon compressible member 28 and sleeve 30.

Accordingly, when automatic flow adjuster 12 begins to rise above support surface 26 due to reaction forces caused by fluid expelled through monitor assembly 10, lever 24 extends away from tubular body 22 and pin 42 moves toward its retracted position (FIG. 5). As pin 42 unblocks passageway 30*p* of sleeve 30, a portion of pressurized firefighting fluid from passageway 23 is directed through passageway 30*p* and into annular chamber 38. The pressure of the firefighting fluid in annular chamber 38 applies axial force to piston head 32*b* of adjuster 32, which urges adjuster 32 along the longitudinal axis in the direction of fluid flow, which is indicated by arrows in FIGS. 3 and 5.

As adjuster 32 begins to move, corresponding ramped surfaces 32*a*, 30*c* of adjuster 32 and sleeve 30 begin to slide relative to one another and force a downstream portion of sleeve 30 radially inward, thus compressing flexible beams 28*a* of compressible member 28 radially inward as well. The radial constriction of sleeve 30 and compressible member 28 constricts the flow area through flow restrictor 12, which reduces the flow rate through monitor assembly 10 and reduces the reaction forces applied to monitor assembly 10 by the discharge of fluid therethrough.

As the reaction forces are reduced, flow adjuster 12 will stop rising above support surface 26, which will hold lever 24 and pin 42 in position and hold the flow rate steady. Flow adjuster 12 may lower somewhat toward surface 26 as reaction forces are reduced, which will compress lever 24 toward tubular body and extend pin 42 toward and/or into passageway 30*p* of sleeve 30, thus reducing or preventing additional pressurized fluid from entering chamber 38 and acting upon adjuster 32.

Figure 6:
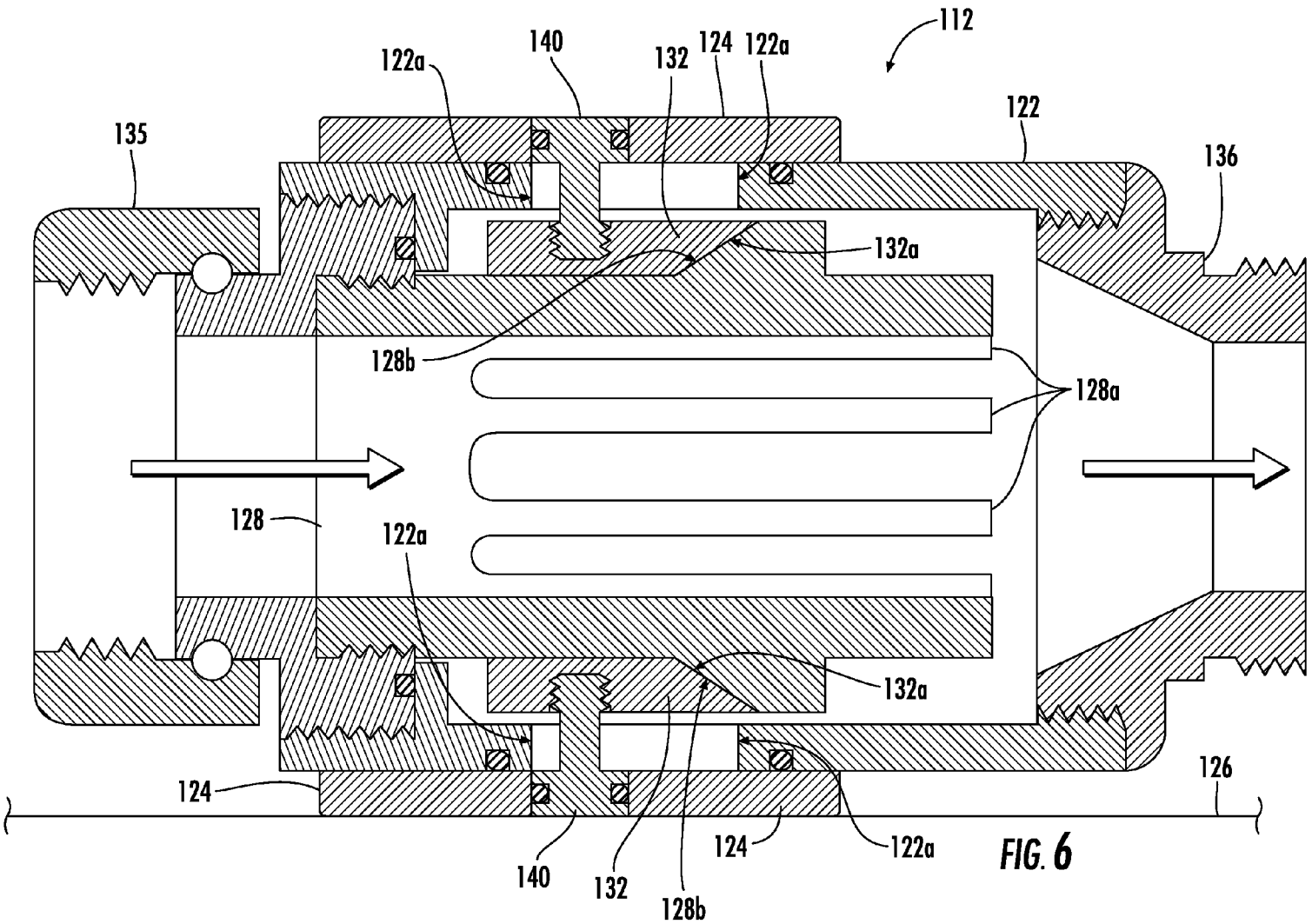
FIG. 6 is a side sectional view of another flow restricting device according to the present invention.

Optionally, and with reference to FIG. 6, an automatic flow restrictor 112 includes a tubular body 122, a slidable member 124 such as an actuation collar, a compressible member 128 with flexible beams 128*a*, an actuator or adjuster 132, an inlet member 135, and an outlet member 136. Compressible member 128 is similar to compressible member 28, except that compressible member 128 includes integral ramped surfaces 128*b* on flexible beams 28*a* configured for engagement with corresponding ramped surfaces 132*a* of actuator 132.

Actuator 132 is engaged by one or more fasteners or couplers 140 that pass through corresponding slots 122*a* in tubular body 122 and are coupled to actuation collar 124. Actuation collar 124 is axially repositionable along tubular 122 to the extent permitted by fasteners 140 traversing along slots 122*a*. Actuation collar 124 is urged along tubular body 122 in response to movement of flow restrictor 112 along a support surface 126. As actuation collar 124 moves axially along tubular body 122 in the fluid flow direction (indicated by arrows in FIG. 6), such as in response to movement of flow restrictor 112 along support surface 126 in an opposite direction of the fluid flow (due to reaction forces), actuator 132 is urged in the downstream direction so that flexible beams 128*a* are compressed or constricted inwardly to reduce the flow area available through, past, and between the flexible beams of the compressible member. The corresponding reduction in flow rate reduces the forces acting upon automatic flow restrictor 112 in order to prevent further movement of the flow restrictor along the support surface 126, while maintaining a maximum flow rate without causing further movement of flow restrictor 112 and the associated firefighting apparatus.

Accordingly, the present invention provides a flow restrictor that automatically reduces the flow rate of fluid through a firefighting apparatus in response to undesired movement of the restrictor and/or apparatus. Sliding movement over a support surface may be detected by a sensor such as a collar on the flow restrictor, and movement away from a support surface may be detected by another sensor such as a movable lever or the like. A compressible member is compressed or constricted by an adjuster that tightens around the compressible member in response to movement of the sensor, and restricts fluid flow to reduce reaction forces acting upon the flow restrictor to thereby limit or prevent farther movement of the flow restrictor and associated firefighting apparatus.

Changes and modifications in the specifically described embodiments may be carried out with departing from the principles of the present invention, which is intended to be limited only the scope of the appended claims, as interpreted according to the principles of patent law including the doctrine of equivalents.

The invention claimed is:

1. An automatic flow restrictor for selectively restricting a fluid flowing through a firefighting apparatus, said automatic flow restrictor comprising:

a tubular body having a longitudinal central axis, an inlet, and an outlet;

a passageway extending between said inlet and said outlet;

a compressible member defining at least a portion of said passageway, said compressible member having an inner dimension transverse to the longitudinal central axis;

an adjuster mounted about said compressible member for selectively compressing the compressible member to selectively restrict the flow of fluid through said tubular body;

wherein said compressible member is adjustable between an open position and a flow-restricting position in response to said adjuster, and wherein said adjuster is actuatable in response to movement of said tubular body with respect to a support surface on which said automatic flow restrictor is supported;

wherein said compressible member comprises a plurality of compressible members; and wherein said adjuster extends around said compressible member and is adapted to move along said longitudinal central axis, a slidable member applying pressure on said adjuster, and said adjuster applying compressive pressure on said compressible member.

2. The automatic flow restrictor of claim 1, wherein said slidable member is adapted to move axially along said tubular body in response to sliding movement of said tubular body along the support surface, and wherein said slidable member is operable to actuate said adjuster in response to the movement.

3. The automatic flow restrictor of claim 2, wherein said slidable member comprises a high-friction material.

4. The automatic flow restrictor of claim 2, wherein said slidable member comprises a collar.

5. The automatic flow restrictor of claim 4, wherein said slidable member comprises a high-friction material.

6. The automatic flow restrictor of claim 1, wherein said compressible member includes a ramped portion, wherein linear travel of said adjuster along said longitudinal central axis in a first direction applies a compressive force on said compressible member and wherein linear travel of said adjuster along said longitudinal central axis in a second direction allows said compressible member to expand under the force of the fluid pressure flowing through the firefighting apparatus.

7. The automatic flow restrictor of claim 1, further in combination with a firefighting monitor.

8. An automatic flow restrictor for selectively restricting a fluid flowing a firefighting apparatus, said automatic flow restrictor comprising:

a tubular body having a longitudinal central axis, an inlet, and an outlet;

a passageway extending between the inlet and said outlet;

a compressible member defining at least a portion of said passageway, said compressible member having an inner dimension transverse to the longitudinal central axis;

an adjuster mounted about the compressible member for selectively compressing the compressible member to selectively restrict the flow of fluid through the tubular body;

wherein said compressible member is adjustable between an open position and a flow-restricting position in response to said adjuster, and wherein said adjuster is actuatable in response to movement of said tubular body with respect to a support surface on which said automatic flow restrictor is supported;

wherein said compressible member comprises a plurality of compressible members; and wherein each of said compressible members comprises a cantilevered beam;

wherein said adjuster extends around said compressible member and is adapted to move along said longitudinal central axis, a slidable member applying pressure on said adjuster, and said adjuster applying compressive pressure on said compressible member.

9. The automatic flow restrictor of claim 8, comprising a slidable member at said tubular body, wherein said slidable member is adapted to move axially along said tubular body in response to sliding movement of said tubular body along the support surface, and wherein said slidable member is operable to actuate said adjuster in response to the movement.

10. The automatic flow restrictor of claim 9, wherein said slidable member comprises a high-friction material.

11. The automatic flow restrictor of claim 9, wherein said slidable member comprises a collar.

12. The automatic flow restrictor of claim 11, wherein said slidable member comprises a high-friction material.

13. The automatic flow restrictor of claim 8, wherein said compressible member includes a ramped portion, wherein linear travel of said adjuster along said longitudinal central axis in a first direction applies a compressive force on said compressible member and wherein linear travel of said adjuster along said longitudinal central axis in a second direction allows said compressible member to expand under the force of the fluid pressure flowing through the firefighting apparatus.

14. The automatic flow restrictor of claim 8, further in combination with a firefighting monitor.

15. An automatic flow restrictor for selectively restricting a fluid flowing through a firefighting apparatus, said automatic flow restrictor comprising:

a tubular body having a longitudinal central axis, an inlet, and an outlet; a passageway extending between said inlet and said outlet;

a compressible member defining at least a portion of said passageway, said compressible member having an inner dimension transverse to the longitudinal central axis;

an adjuster mounted about said compressible member for selectively compressing the compressible member to selectively restrict the flow of fluid through said tubular body;

a movable actuator coupled to said tubular body;

a sleeve surrounding at least a portion of said compressible member in said passageway, said sleeve defining an aperture for fluid communication through a wall of said sleeve;

a chamber defined between said sleeve, said adjuster, and said tubular body, said chamber in selective fluid communication with said passageway;

a pin coupled to said movable actuator and extending transversely through an aperture in said tubular body, said pin adapted to selectively block said aperture of said sleeve in response to inward movement of said movable actuator toward said tubular body, and said pin adapted to selectively unblock said aperture in response to outward movement of said movable actuator away from said tubular body;

wherein said compressible member is adjustable between an open position and a flow-restricting position in response to said adjuster, and wherein said adjuster is actuatable in response to movement of said tubular body with respect to a support surface on which said automatic flow restrictor is supported; and wherein said chamber is in selective fluid communication with said passageway via said aperture of said sleeve when said pin is removed from said aperture of said sleeve by movement of said movable actuator away from said tubular body in response to said tubular body moving away from the support surface, wherein pressurized fluid from said passageway enters said chamber and urges said adjuster along said compressible member, said adjuster applying compressive pressure on said compressible member to restrict the flow of the fluid through said passageway.

16. The automatic flow restrictor of claim 15, wherein said movable actuator comprises a pivotally mounted lever.

17. The automatic flow restrictor of claim 16, wherein said adjuster comprises an annular piston extending around said compressible member and being movable along said longitudinal central axis in response to fluid pressure in said chamber applying pressure on said piston, and said piston applying compressive pressure on said compressible member.

18. The automatic flow restrictor of claim 17, wherein said compressible member includes a ramped distal end portion, wherein linear travel of said piston along said longitudinal central axis in a first direction applies a compressive force on said compressible member and wherein linear travel of said piston along said longitudinal central axis in a second direction allows said compressible member to expand under the force of the fluid pressure flowing through said passageway.

19. The automatic flow restrictor of claim 15, wherein said adjuster comprises an annular piston extending around said compressible member and being movable along said longitudinal central axis in response to fluid pressure in said chamber applying pressure on said piston, and said piston applying compressive pressure on said compressible member.

20. The automatic flow restrictor of claim 15, wherein said compressible member includes a ramped distal end portion, wherein linear travel of said piston along said longitudinal central axis in a first direction applies a compressive force on said compressible member and wherein linear travel of said piston along said longitudinal central axis in a second direction allows said compressible member to expand under the force of the fluid pressure flowing through said passageway.

21. The automatic flow restrictor of claim 15, wherein said compressible member comprises a plurality of compressible members.

22. The automatic flow restrictor of claim 21, wherein each of said compressible members comprises a cantilevered beam.

23. The automatic flow restrictor of claim 15, further in combination with a firefighting monitor.

* * * * *